US008992275B1

(12) United States Patent
Woods

(10) Patent No.: US 8,992,275 B1
(45) **Date of Patent: *Mar. 31, 2015**

(54) MARINE WATER DROP MUFFLER

(76) Inventor: Woodrow Woods, Riviera Beach, FL (US)

( * ) Notice: Subject to any disclaimer, the term of this patent is extended or adjusted under 35 U.S.C. 154(b) by 249 days.

This patent is subject to a terminal disclaimer.

(21) Appl. No.: 13/590,538

(22) Filed: Aug. 21, 2012

Related U.S. Application Data

(63) Continuation-in-part of application No. 12/754,899, filed on Apr. 6, 2010, now Pat. No. 8,246,403.

(60) Provisional application No. 61/166,882, filed on Apr. 6, 2009.

(51) Int. Cl.
*B63H 21/32* (2006.01)
*F01N 13/00* (2010.01)

(52) U.S. Cl.
CPC ..... *B63H 21/32* (2013.01)
USPC ..... 440/89 F

(58) Field of Classification Search
CPC ..... B63H 21/32; B63H 20/24; B63H 21/34; B63H 21/38
USPC ..... 440/89 R, 89 E, 89 F, 89 G, 89 H, 89 J; 181/230, 250, 296; 89/198
See application file for complete search history.

(56) References Cited

U.S. PATENT DOCUMENTS

| | | | | |
|---|---|---|---|---|
| 4,244,442 | A * | 1/1981 | Scarton et al. | 181/230 |
| 4,327,817 | A * | 5/1982 | Scarton et al. | 181/296 |
| 4,918,917 | A | 4/1990 | Woods | |
| 5,022,877 | A | 6/1991 | Harbert | |
| 5,196,655 | A | 3/1993 | Woods | |
| 5,228,876 | A | 7/1993 | Woods | |
| 5,262,600 | A | 11/1993 | Woods | |
| 5,444,196 | A | 8/1995 | Woods | |
| 5,504,280 | A | 4/1996 | Woods | |
| 5,616,893 | A | 4/1997 | Woods | |
| 5,625,173 | A | 4/1997 | Woods | |
| 5,718,462 | A | 2/1998 | Woods | |
| 5,740,670 | A | 4/1998 | Woods | |
| 5,746,630 | A | 5/1998 | Ford et al. | |
| 6,564,901 | B2 | 5/2003 | Woods | |
| 6,591,939 | B2 | 7/2003 | Smullin et al. | |
| 7,207,258 | B1 * | 4/2007 | Scanlon | 89/198 |
| 7,854,297 | B2 * | 12/2010 | Scanlon | 181/250 |

* cited by examiner

*Primary Examiner* — Daniel V Venne
(74) *Attorney, Agent, or Firm* — Mark D. Bowen; Malin Haley DiMaggio & Bowen, P.A.

(57) ABSTRACT

A water drop muffler for use in a marine exhaust system to silence exhaust noise while separating entrained water from exhaust gas using hydro-dynamic centrifugal separation principles enhanced by turbulent flow. A muffler housing defines an internal volume bounded by a generally vertically disposed cylindrical inner surface formed about a longitudinal axis. An exhaust inlet receives a mixture of exhaust gas and entrained cooling water. A flow channel transitions the flow for discharge through an opening thereby creating vortex flow within the housing to maximize the generation of centrifugal forces. Water is drawn toward the cylindrical inner surface and allowed drain from the housing.

5 Claims, 9 Drawing Sheets

MARINE WATER DROP MUFFLER

CROSS REFERENCE TO RELATED APPLICATIONS

This application is a continuation-in-part of U.S. patent application Ser. No. 12/754,899, filed on Apr. 6, 2010, which claims the benefit of provisional U.S. Patent Application Ser. No. 61/166,882, filed on Apr. 6, 2009.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates generally to exhaust systems and mufflers for use with internal combustion marine engines, and more particularly to a water drop marine engine muffler that uses centrifugal force and turbulence to separate entrained water from marine exhaust gas thereby combining improved water separation and handling characteristics with enhanced noise reduction.

2. Description of Related Art

Marine vessels are typically configured with a propulsion system having an internal combustion engine mounted internally within the vessel hull. Exhaust generated by the engine is commonly combined with cooling water and routed through exhaust conduit to the stern or rear of the vessel via one or more exhaust ducts for discharge through one or more exhaust ports formed in the transom. One or more silencers may be installed within the exhaust duct(s) to silence noise associated with the engine and exhaust gases.

A variety of structures are known in the background art for use in silencing marine exhaust noise. The present inventor has invented a number of novel marine exhaust components that have greatly improved the silencing and efficiency of marine exhaust systems. Among those inventions developed by a named inventor for the present invention are the following:

| U.S. Pat. No. | Entitled |
|---|---|
| 4,918,917 | Liquid Cooled Exhaust Flange |
| 5,196,655 | Muffler for Marine Engines |
| 5,228,876 | Marine Exhaust System Component Comprising a Heat Resistant Conduit |
| 5,262,600 | In-line Insertion Muffler for Marine Engines |
| 5,444,196 | In-line Insertion Muffler for Marine Engines |
| 5,504,280 | Muffler for Marine Engines |
| 5,616,893 | Reverse Entry Muffler With Surge Suppression Feature |
| 5,625,173 | Single Baffle Linear Muffler for Marine Engines |
| 5,718,462 | Muffler Tube Coupling With Reinforcing Inserts |
| 5,740,670 | Water Jacketed Exhaust Pipe for Marine Exhaust Systems. |
| 6,564,901 | Muffler for Marine Engine |

The present inventor's prior advancements in the art have been primarily directed to muffler structures wherein water generally remains entrained with the exhaust gas. In certain applications, however, it is desirable to separate water from exhaust gas. In these situations, the use of a muffler capable of receiving a mixture of exhaust and entrained water and separating the water from the exhaust gas is required. Such mufflers are sometimes referred to as "water drop mufflers". Water separation effectiveness is a primary concern for water drop mufflers.

A typical water drop muffler is disclosed in U.S. Pat. No. 5,022,877, issued to Harbert. Harbert discloses a water drop muffler that relies primarily on gravity to separate the exhaust gas from the water. U.S. Pat. No. 6,591,939, issued to Smullin et al., discloses a marine engine silencer that attempts to dynamically separate water from exhaust gas by linear momentum effect or centrifugal effect. Smullin distinguishes muffler structures that separate water from exhaust gases by dynamic separation due to linear momentum or centrifugal effects from passive-restraining or non-dynamic effects, such as gravitational effects. Smullin claims to achieve centrifugal separation of water by providing a circular (or partially curved) interior surface that causes the fluid mixture to swirl. The structure disclosed by Smullin, however, is overly complex, dynamically inefficient, and otherwise fails to truly maximize the use of centrifugal forces to achieve water separation.

U.S. Pat. No. 5,746,630, issued to Ford et al., discloses a water drop muffler that primarily relies on centrifugal effects to separate entrained cooling water from exhaust gas. Ford discloses a generally cylindrical housing having a tangential inlet for receiving a mixture of exhaust gas and entrained cooling water, and an inlet baffle for deflecting the exhaust flow along the inner wall of the housing. The inlet baffle defines a parabolic trailing edge that Ford claims to have been found helpful in imparting the desired swirling pattern to the fluid mixture admitted through the inlet pipe. Once separated from exhaust gas, the water exits the housing through a second pipe. The tangential inlet and baffle structure disclosed by Ford, however, comprises a fluid handling structure that is inefficient in a fluid dynamic sense, and thus fail to maximize the generation of centrifugal forces thereby resulting in less than optimal water separation performance.

The water drop mufflers disclosed in the art rely on overly complex structures and fail to maximize the use of centrifugal forces to separate entrained cooling water from exhaust gas. As a result there remains a need in the art for an improved water drop muffler that maximizes the use of centrifugal forces to achieve water separation.

BRIEF SUMMARY OF THE INVENTION

The present invention overcomes limitations present in the art by providing an improved water drop muffler for use in a marine exhaust system to silence exhaust noise while separating entrained cooling water from exhaust gas using hydrodynamic centrifugal separation principles enhanced by turbulent flow. A water drop muffler in accordance with the present invention includes a housing having a top and a bottom, and defining an internal volume bounded by a generally vertically disposed cylindrical inner surface formed about a longitudinal axis. The housing further includes a generally tubular exhaust inlet, which is preferably disposed in generally tangential relation with the cylindrical inner housing surface for receiving a mixture of exhaust gas and entrained cooling water. The tubular inlet is in fluid communication with a variable geometry flow channel that efficiently transitions the flow for discharge through an elongate vertically disposed opening located along the housing inner surface thereby creating vortex flow within the housing to maximize the generation of centrifugal forces and turbulent boundary layer flow. The variable geometry flow channel transitions the exhaust conduit from the generally tubular exhaust inlet to a generally rectangular, vertically oriented outlet disposed substantially adjacent to housing's cylindrical inner surface. This channel results in forming an exhaust flow profile that includes turbulent boundary layer flow along a significant circumferential length of the cylindrical inner surface while avoiding flow stagnation. The vortex flow formed within the housing causes the relatively heavy water droplets and water vapor (i.e. steam) to be drawn away from the housing axis toward the cylindrical inner surface of the housing. In addition, turbulent boundary layer flow along the surfaces of the variable geometry flow channel and the other housing surfaces function to more efficiently draw entrained water droplets and steam into contact with various surfaces within the housing thereby causing water to coalesce along the inner housing surfaces.

The housing further includes a water pan disposed in spaced relation with the bottom of the housing. The water pan includes a bottom having an upwardly projecting conical surface and a peripheral side wall having a radially outwardly projecting annular lip formed in sealing engagement with the inner surface of the housing. The water pan thus partitions the housing internal volume into a vortex flow chamber (disposed above the water pan) and a water collection chamber (disposed below the water pan). Water that is separated from the exhaust vortex pools in the water pan and openings defined in the pan peripheral side wall allow the water flow out of the water pan and into the water collection chamber below. Once in the water collection chamber the water is generally isolated from the exhaust gas flow within the vortex chamber thereby preventing the water from agitation and becoming entrained and or evaporated back into the exhaust gas. A plurality of angularly spaced, radially aligned and vertically disposed vanes are located between the bottom of the water pan and the bottom of the housing. The vanes function as water brakes by forming barriers that interrupt swirling flow patterns while further functioning as vertical spacers and/or supports for the water pan. Water in the water collection chamber flows out of the housing via a water outlet via gravity and/or pressure. Exhaust gas in the vortex chamber enters the bell-shaped mouth of an exhaust gas outlet pipe that projects out the top portion of the housing to duct exhaust gas to down stream exhaust system components for discharge from the vessel.

Accordingly, it is an object of the present invention to provide an improved marine water drop muffler.

Still another object of the present invention is to provide such a marine water drop muffler wherein water separation is achieved using centrifugal forces enhanced by boundary layer turbulence.

Yet another object of the present invention is to provide such a muffler water drop muffler wherein the generation of centrifugal force is maximized by use of a variable geometry flow channel that transitions and accelerates inlet flow through a hydro-dynamically efficient elongate vertical opening disposed along the length of the housing inner surface.

Still another object of the present invention involves

In accordance with these and other objects, which will become apparent hereinafter, the instant invention will now be described with particular reference to the accompanying drawings.

DETAILED DESCRIPTION OF THE INVENTION

With reference now to the drawings, FIGS. 1-9 depict a marine water drop muffler, generally referenced as 10, in accordance with the present invention. The present invention overcomes limitations present in the art by providing an improved water drop muffler for use in a marine exhaust system to silence exhaust noise while separating entrained cooling water from "wet" exhaust gas using hydro-dynamic centrifugal separation principles enhanced by boundary layer turbulent flow.

Figure 1:
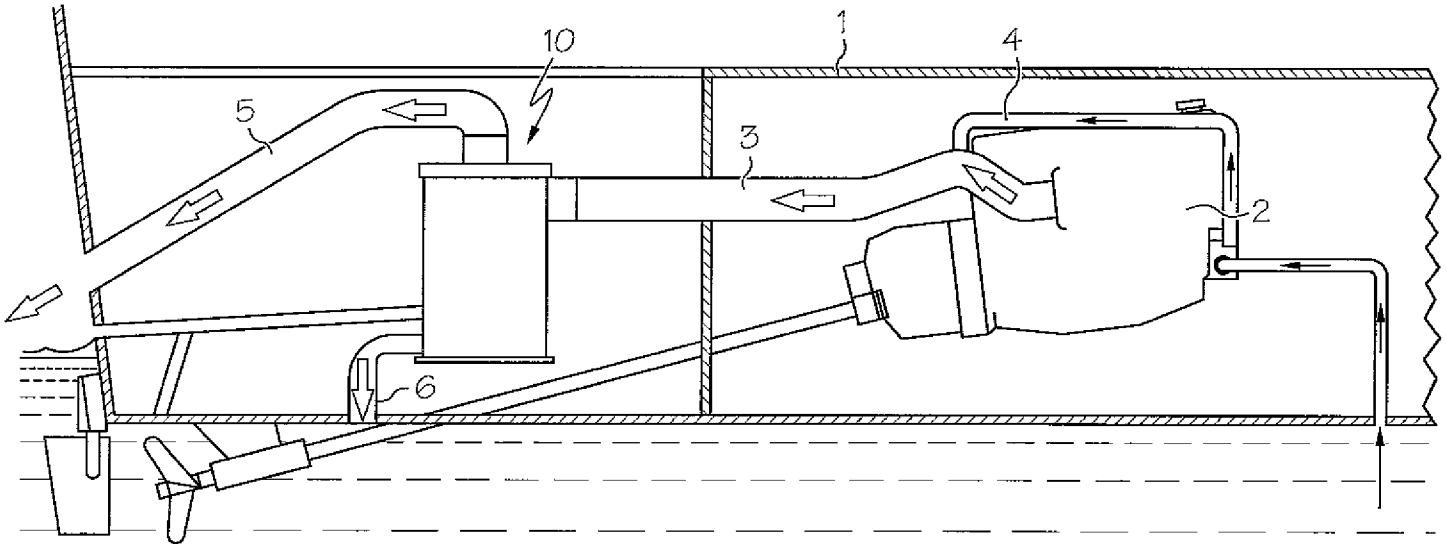
FIG. 1 is a side sectional view of a marine vessel adapted with a water drop muffler in accordance with the present invention.

FIG. 1 is a partial sectional view of a marine vessel, generally referenced as 1, having a water drop muffler, generally referenced as 10, in accordance with the present invention. Marine vessel 1 includes an internal combustion engine 2 having an exhaust conduit 3 connected to a cooling water supply line 4. Exhaust conduit 3 contains a mixture of exhaust gas and cooling water and is in communication with the inlet of water drop muffler 10 of the present invention. Muffler 10 is further connected to an exhaust outlet conduit 5, and a water outlet conduit 6. The exact configuration of engine 2, exhaust conduit 3, and water supply line 4, may vary from vessel to vessel, and it should be appreciated that the water drop muffler of the present invention may be installed in any suitable vessel in any suitable exhaust system configuration.

Figure 8:
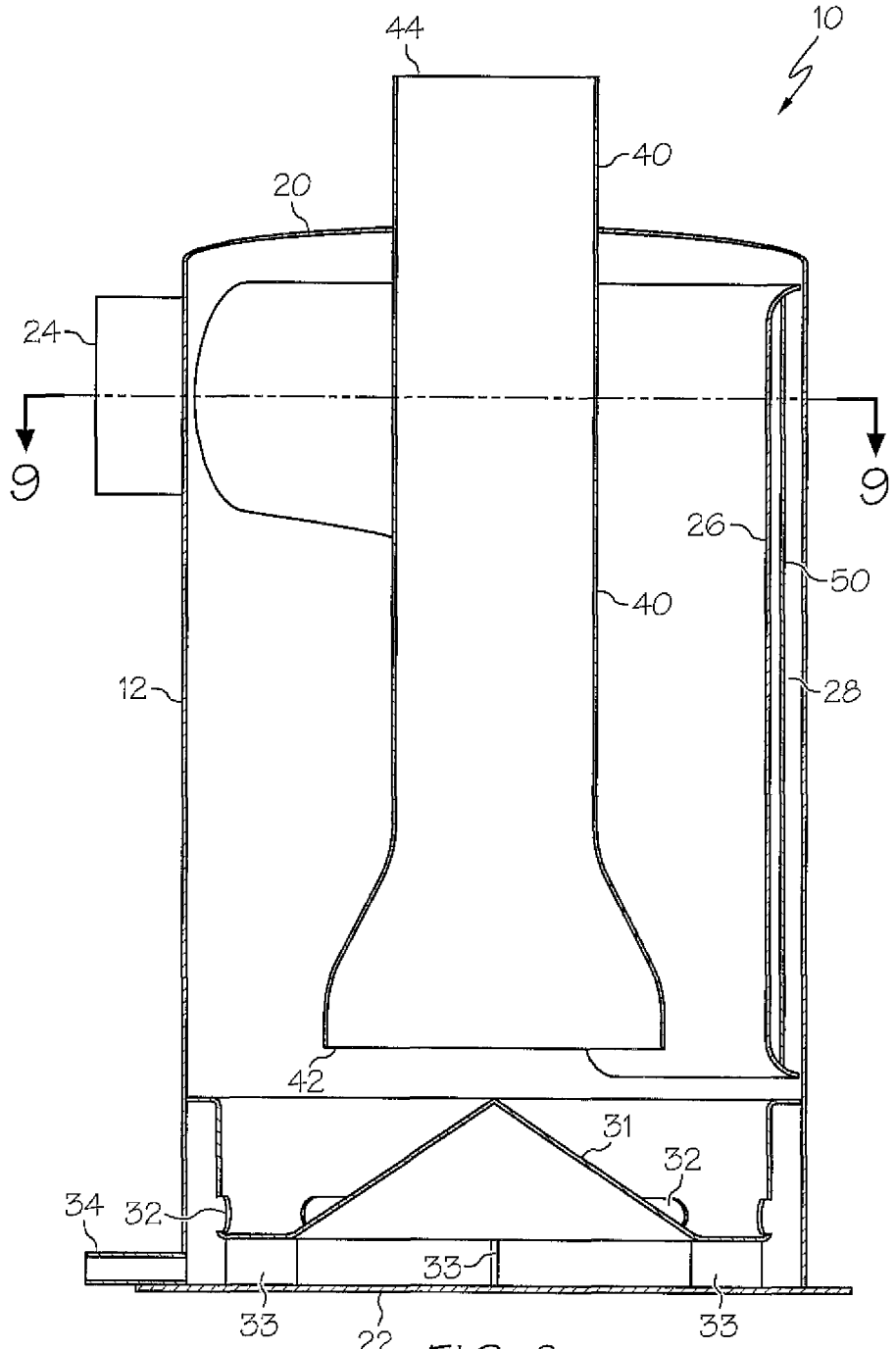
FIG. 8 is a sectional view taken along section line 2-2 of FIG. 3 with the addition of a coalescing vane.
Figure 9:
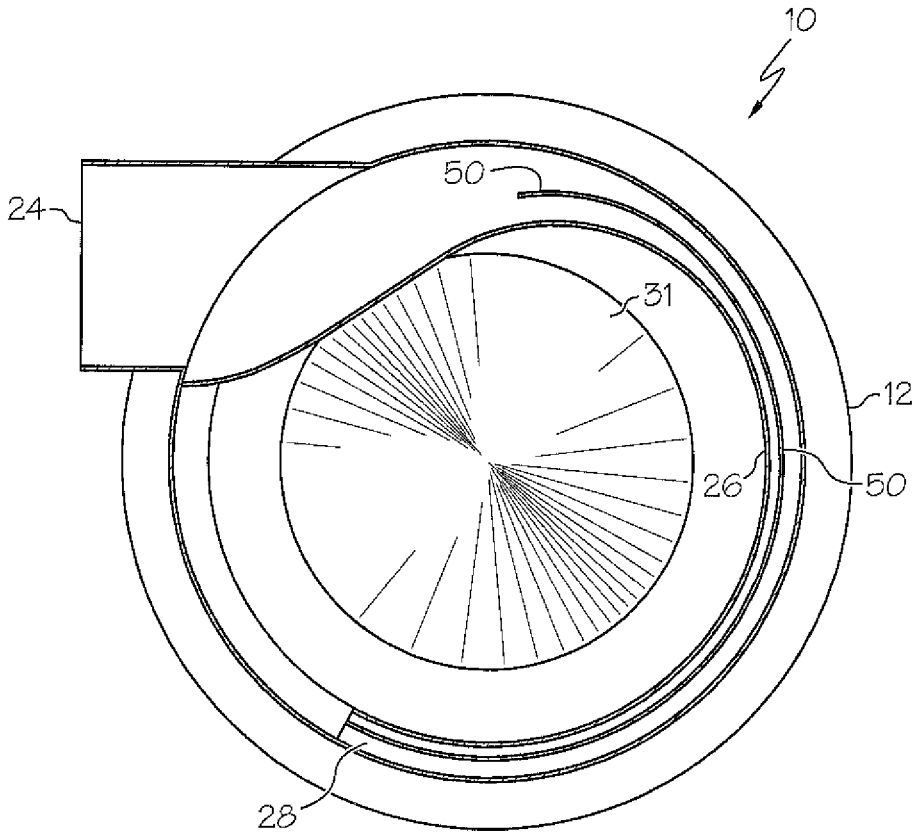
FIG. 9 is a sectional view taken along line 9-9 of FIG. 8.

FIGS. 2-7 depict detailed views of a first embodiment of marine muffler 10, and FIGS. 8-9 depict a second embodiment thereof that includes an optional coalescing vane 50. Marine water drop muffler 10 includes a housing 12 defining an internal volume 14 bounded by a generally vertically disposed cylindrical inner surface 16 formed about a longitudinal axis 18. In addition, housing 12 includes an uppermost portion having a top 20, and a lowermost portion having a bottom 22. Housing 12 further includes a generally tubular inlet 24 generally tangentially disposed relative to inner surface 16, and in proximity to the top 20 for receiving wet marine exhaust, namely a mixture of exhaust gas and entrained cooling water. Tubular inlet 24 is preferably disposed in proximity to the top 20 of housing 12, however, inlet 24 may be located at any suitable position between the top 20 and bottom 22 of housing 12. It should be noted that the exhaust gas contains particulate matter, such as hydrocarbon by products of combustion. Further, water may be present in the form of entrained droplets and/or water vapor or steam.

Tubular inlet 24 is in fluid communication with a variable geometry flow channel, generally referenced as 26 (by reference to the radially inner channel wall), which efficiently transitions the exhaust gas flow profile to discharge through an elongate vertically disposed opening 28 formed along a portion of the vertical length of the housing inner surface 16. More particularly, variable geometry flow channel 26 transitions the exhaust conduit from the generally tubular exhaust inlet 24 to a generally rectangular, vertically oriented outlet or terminal opening 28 disposed substantially adjacent to housing's cylindrical inner surface 16 in a hydro-dynamically efficient manner. Variable geometry flow channel 26 preferably extends between 45-degrees and 180-degrees or more around the circumference of inner surface 16. In various embodiments, variable geometry flow channel 26 may be sized to either maintain constant, or increase, the velocity of the exhaust gas entering water drop muffler 10. In an alternate embodiment, variable geometry flow channel 26 may further include one or more internal vanes, referenced as 50, as illustrated in FIGS. 8 and 9, aligned with the direction of flow, to provide increased surface area for the formation of turbulent boundary layer flow to maximize the coalescence of water. Housing 12 and its major structural components are preferably fabricated from fiberglass, metal, such as stainless steel, or any other suitable corrosion resistant material, heat resistant material, or combination of such materials.

Figure 5:
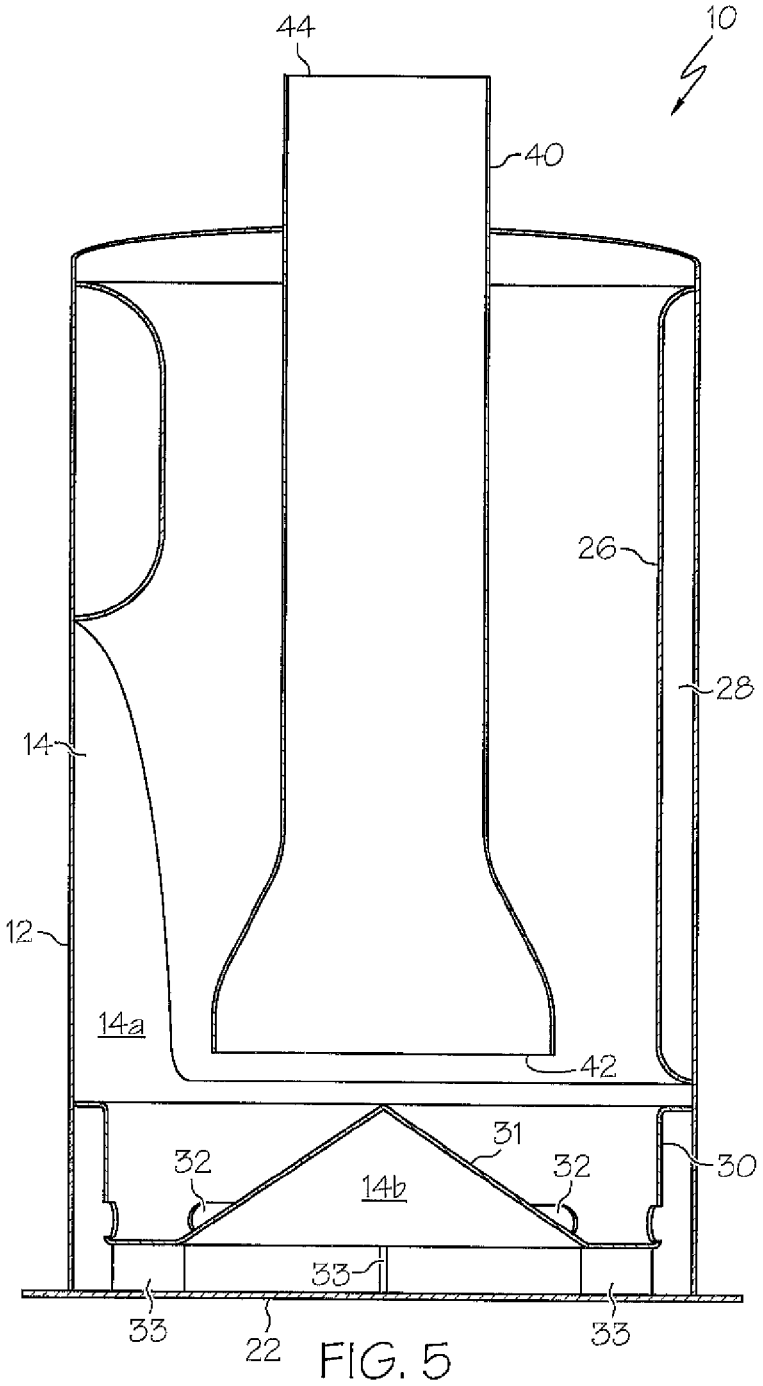
FIG. 5 is a sectional view thereof taken along section line 5-5 of FIG. 4.
Figure 6:
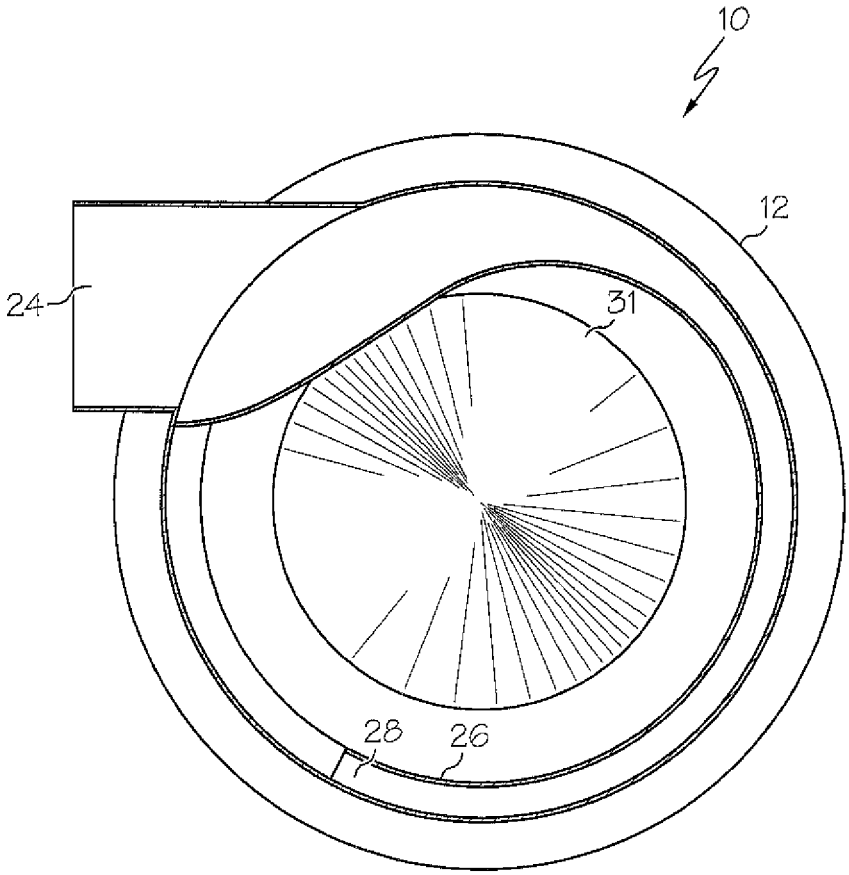
FIG. 6 is a sectional view thereof taken along section line 6-6 of FIG. 2.
Figure 7:
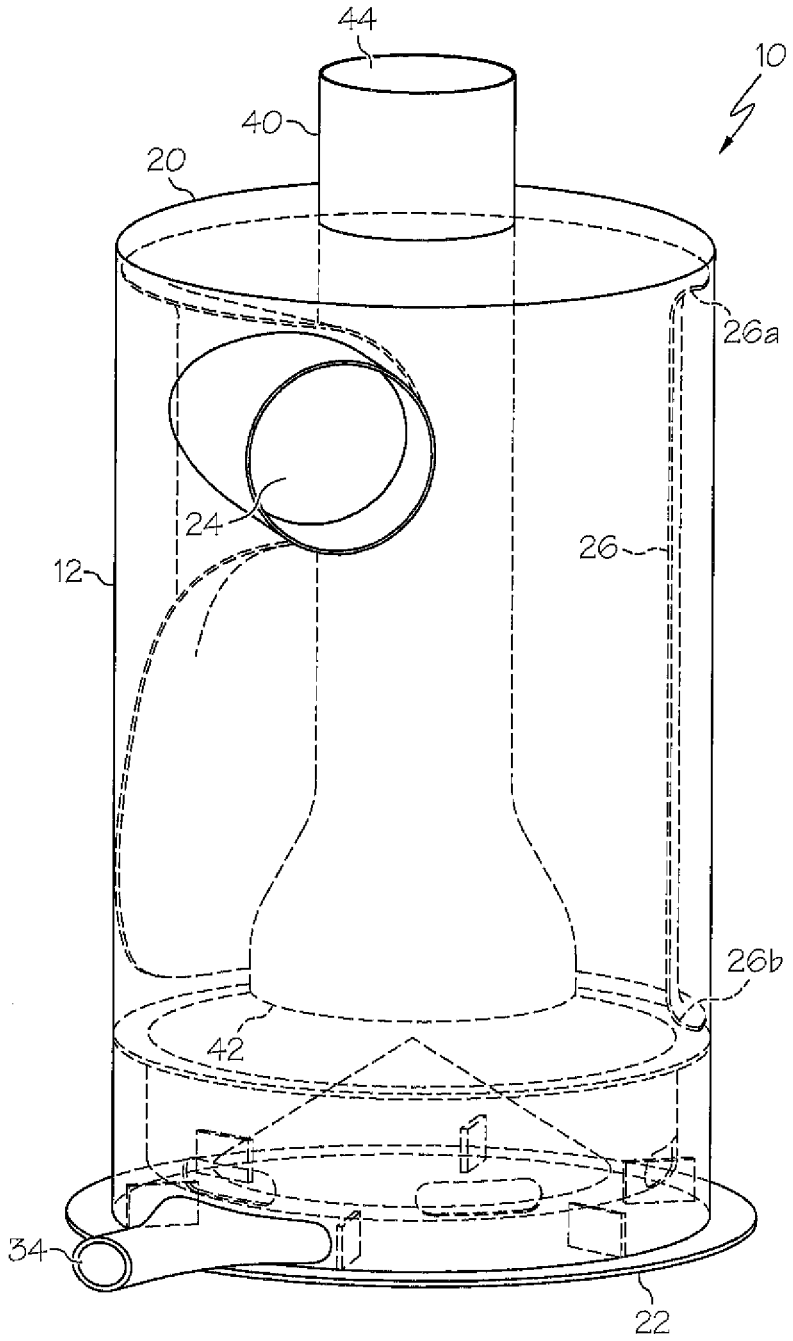
FIG. 7 is a perspective view with hidden lines illustrating internal structure.

Wet exhaust enters muffler 10 through inlet 24 and is routed into the variable geometry flow channel or duct 26 whereby the exhaust flow profile is transitioned and exits opening 28 having a flow profile characteristic that is vertically elongate and relatively thin when measured in the radial direction (e.g. from inner surface 16 toward longitudinal axis 18). As used herein the terms "flow channel" shall mean an exhaust duct confining exhaust gas flow and shaping the flow profile of exhaust gas. As a result, exhaust gas is discharged from opening 28 onto inner surface 16 along a substantial portion of the housing dimension measured from top to bottom. As noted above, the flow velocity may further be increased within flow channel 26 to maximize the generation of centrifugal forces. Variable geometry flow channel 26 is bounded at the radially outer bound by the generally cylindrical inner surface 16, at the radially inner bound by the channel wall 26 disposed in spaced relation with inner surface 16, at the uppermost portion by a radially outwardly turned top portion 26*a* of wall 26, and at the lowermost portion by a radially outwardly turned bottom portion 26*b* of wall 26. Furthermore, the distance between the inner surface 16 of housing 12 and the channel wall 26 preferably decreases in the direction of flow. The curvature of the lowermost portion of flow channel 26 preferably descends in a non-linear manner as can be seen in FIG. 5. In a preferred embodiment, variable geometry flow channel 26 further defines a reduction in cross-sectional area from the inlet thereof (in proximity to exhaust inlet 24) to the terminal outlet 28 thereof whereby exhaust velocity may be increased. Variable geometry flow channel 26 preferably results in an exhaust flow profile that includes boundary layer flow from generally near the uppermost portion of housing 12 downward a significant length along cylindrical inner surface 16 thereby significantly avoiding regions of flow stagnation. Exhaust gas and entrained cooling water exiting outlet 28 of flow channel 26 preferably forms a vortex about axis 18 within housing 12. As the exhaust flow vortex is formed about longitudinal axis 18 the relatively heavy water droplets and water vapor spiral away from the housing axis toward the cylindrical inner surface where turbulent boundary layer flow functions to maximize the coalescence and deposit of water and particulate matter onto the inner surface 16, and both internal and external surfaces of flow channel 26.

It has been found that the vortex chamber 14*a* absorbs acoustical energy thereby significantly contributing to the silencing of the muffler discharge. More particularly, the combination of water laden turbulent boundary layer flow over a substantial portion of the inner surface functions to form a radially outer sound barrier thereby providing exceptional sound attenuation.

Figure 2:
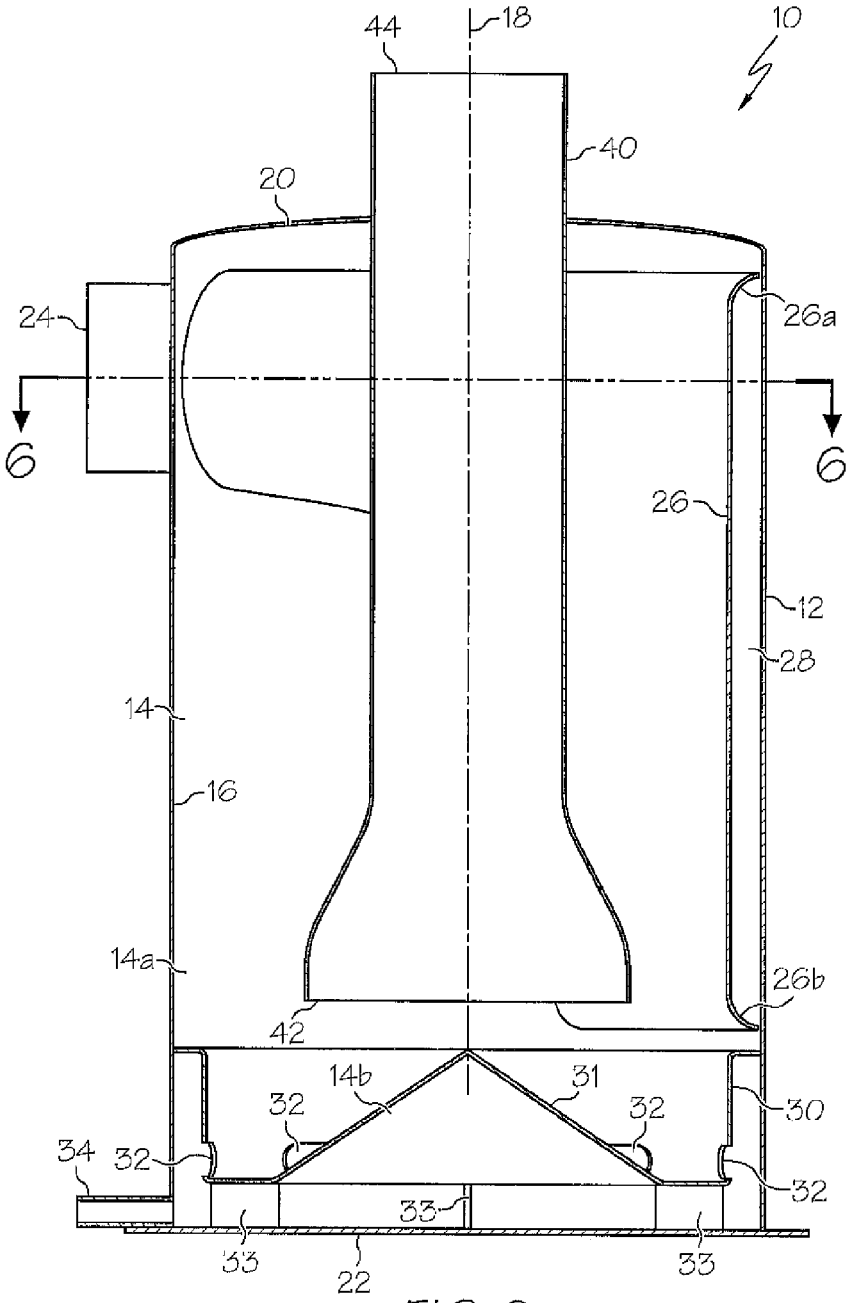
FIG. 2 is a sectional view thereof taken along section line 2-2 of FIG. 3.
Figure 3:
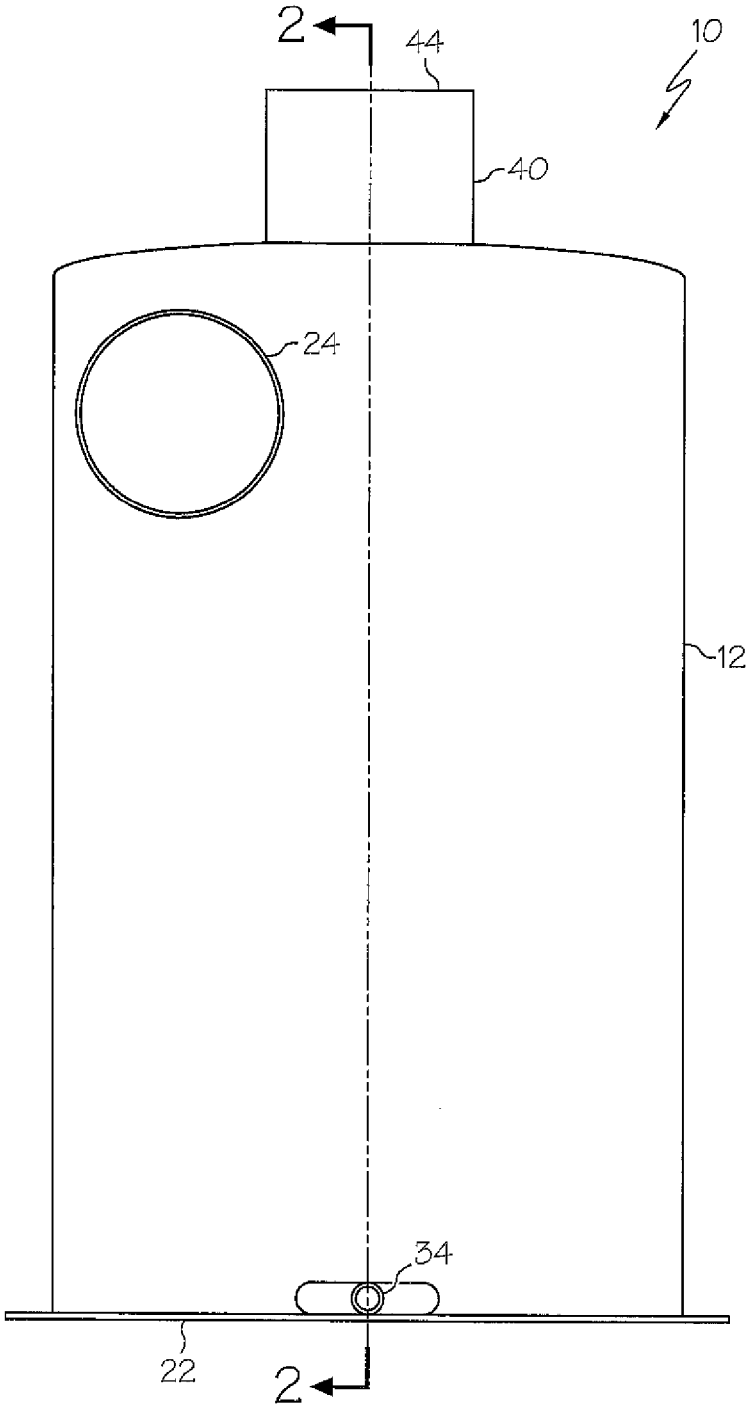
FIG. 3 is a rear view thereof.
Figure 4:
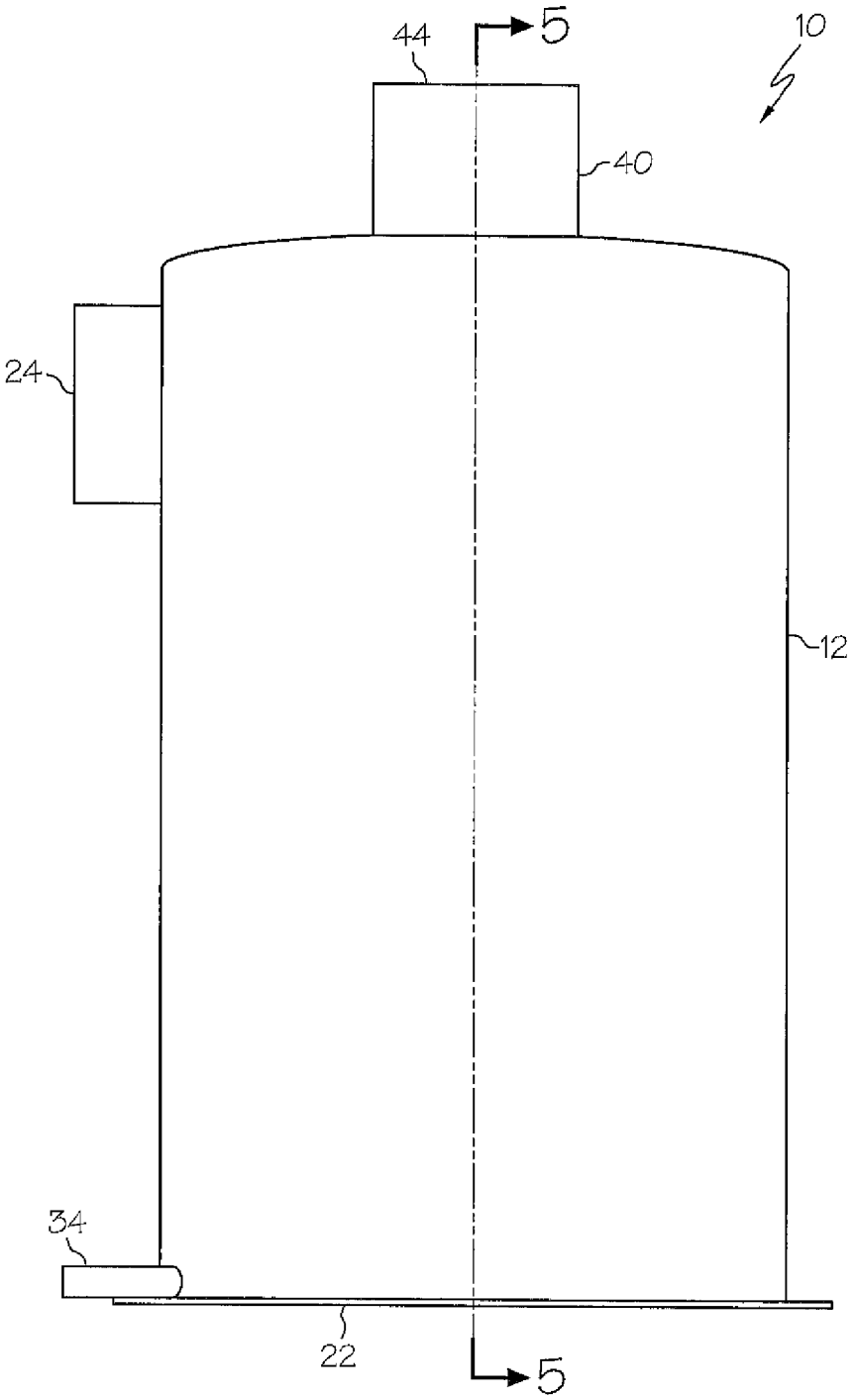
FIG. 4 is a side view thereof.

Housing 12 further includes a water pan 30 having a generally conical baffle 31 projecting upward as best illustrated in FIGS. 2 and 5. Water pan 30 partitions the internal volume 14 into an upper/exhaust-vortex chamber 14*a* (disposed above water pan 30 and baffle 31) and a lower/water-collection chamber 14*b* (disposed below water pan 30 and baffle 31). While baffle 31 is illustrated as generally conical, the present invention contemplates alternate shapes including dome shaped, generally convex shapes, or any other suitable shape. Baffle 30 decreases the volume of vortex chamber 14*a* and thereby minimizes fluid flow "dead space" (e.g. areas of flow stagnation) so as to contribute in maintaining a high circulatory velocity within vortex chamber 14*a* thereby causing particulate matter to coalesce along the housing inner surface 16. The vortex chamber 14*a* relies on centrifugal force to collect and compress together exhaust gas and water particles in a manner, prior to separation, that causes water particles to more effectively absorb or hold into suspension the hydrocarbon by products of combustion so that they may be subsequently eliminated along with water discharged from muffler 10. Further, the turbulent boundary layer flow formed along inner surface 16 functions to maximize the coalescence of liquid from entrained water droplets and water vapor.

Water that is coalesced and deposited on the various surfaces migrates under the influence of gravity into water pan 30. A plurality of openings 32 are formed in water pan 30 to allow water collected therein to flow out of water pan 30 to the water collection chamber 14*b*. Positioning the water collection chamber 14*b* below the water pan 30 functions to conceal the accumulated water (and particulate matter) and prevent agitation thereof by velocity induced turbulence within the vortex chamber 14*a*. A plurality of angularly spaced, radially aligned and vertically disposed vanes 33 are located between the bottom of the water pan and the bottom of the housing as best seen in FIG. 2. Vanes 33 function as water brakes by forming barriers that interrupt swirling water flow, and may further function as vertical spacers and/or supports for the water pan. Water that accumulates in the water collection chamber 14*b* flows out of the housing via a water outlet pipe 34 under the influence of gravity and/or pressure formed within housing 12. In alternate embodiments, a pump may further assist in water removal.

A generally cylindrical, axially disposed exhaust gas outlet pipe 40 projects from the top 20 of housing 12. Outlet pipe 40 defines an open ended exhaust gas inlet 42 disposed within housing 12 and an open ended exhaust gas outlet 44 disposed externally to housing 12. Dry (or drier) exhaust gas in the vortex chamber 14*a* enters the inlet 42 of an exhaust gas outlet pipe 40 whereby the exhaust may be routed to downstream exhaust components, including exhaust conduit 5, for eventual discharge from the vessel. As best seen in FIG. 2, the lower portion of exhaust gas outlet pipe 40 may include an expanded exhaust gas inlet 42 which is radially enlarged relative to the upper portions of outlet pipe 40. The present inventor contemplates a variety of transition shapes including without limitation a conical shape wherein the transition is linear, and a bell shape as illustrated in FIG. 2 wherein the transition is non-linear. Providing a radially enlarged exhaust gas inlet causes exhaust gas entering inlet 42 to increase in velocity as it moves upward through the narrowing lower portion of exhaust pipe 40. It should be noted, however, that any suitable exhaust gas outlet pipe configuration is considered within the scope of the present invention.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A marine exhaust component comprising:

a housing defining an internal volume bounded by a generally vertically disposed cylindrical inner surface, a top, and a bottom;

an exhaust inlet connected to said housing;

said exhaust inlet in fluid communication with a flow channel terminating in a vertically elongate terminal opening disposed substantially adjacent to said cylindrical inner surface;

a baffle projecting upward from said housing bottom and partitioning said internal volume generally into an upper chamber disposed above said baffle, and a lower chamber disposed below said baffle, said baffle including at least one opening therein to allow water to flow into said lower chamber;

a water outlet pipe having an inlet in fluid communication with said lower chamber, and an outlet;

an exhaust gas outlet pipe in fluid communication with said upper chamber and projecting axially from the top of said housing;

whereby water in said lower chamber flows out of the housing via said water outlet pipe, and exhaust in said upper chamber flows out of said housing via said exhaust outlet pipe.

2. The marine exhaust component according to claim 1, wherein said at least one opening in said baffle includes a plurality of circumferentially spaced openings.

3. The marine exhaust component according to claim 1, wherein said flow channel reduces in cross-sectional area from said exhaust inlet to said elongate terminal opening.

4. A marine exhaust component comprising:

a housing defining an internal volume bounded by a generally vertically disposed cylindrical inner surface, said housing having a top, and a bottom;

a generally tubular wet exhaust inlet connected to said housing between said top and said bottom for receiving wet exhaust from a marine engine, said wet exhaust including exhaust gas and entrained cooling water, said inlet generally disposed in tangential relation with said cylindrical inner surface;

said wet exhaust inlet in fluid communication with a flow channel terminating in a vertically elongate terminal opening disposed substantially adjacent to said cylindrical inner surface, said flow channel reducing in cross-sectional area so as to increase exhaust velocity;

a generally conically-shaped baffle disposed in proximity to said housing bottom and projecting upward therefrom, said baffle partitioning said internal volume generally into an upper chamber disposed above said baffle and a lower chamber disposed below said baffle, said baffle including at least one opening to allow water from said upper chamber to flow through said baffle and into said lower chamber;

a water outlet pipe having an inlet in fluid communication with said lower chamber;

an exhaust gas outlet pipe projecting from the top of said housing, said outlet pipe having an opening in fluid communication with said upper chamber; and whereby water in said lower chamber flows out of the housing via said water outlet pipe, and exhaust gas in said upper chamber flows out of said housing via said exhaust outlet pipe.

5. The marine exhaust component according to claim 4, wherein said baffle includes a plurality of circumferentially spaced openings disposed in proximity to the bottom of said housing.

* * * * *